US011746685B2

(12) United States Patent
Kiwan et al.

(10) Patent No.: US 11,746,685 B2
(45) Date of Patent: Sep. 5, 2023

(54) EXHAUST RESTRICTION DEVICE FOR IMPROVED SENSOR SIGNAL

(71) Applicant: FORD GLOBAL TECHNOLOGIES, LLC, Dearborn, MI (US)

(72) Inventors: Rani Kiwan, Canton, MI (US); Raymond Host, Mount Clemens, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/586,269

(22) Filed: Jan. 27, 2022

(65) Prior Publication Data

US 2023/0235690 A1 Jul. 27, 2023

(51) Int. Cl.

| | |
|---|---|
| ***F01N 3/28*** | (2006.01) |
| ***F01N 13/00*** | (2010.01) |
| ***F01N 13/10*** | (2010.01) |
| ***F01N 1/08*** | (2006.01) |
| ***F01N 1/16*** | (2006.01) |
| ***F01N 3/023*** | (2006.01) |
| ***F02D 9/10*** | (2006.01) |
| ***F01N 13/08*** | (2010.01) |

(52) U.S. Cl.

CPC ..... *F01N 3/2892* (2013.01); *F01N 13/008* (2013.01); *F01N 13/10* (2013.01); *F01N 1/08* (2013.01); *F01N 1/161* (2013.01); *F01N 1/163* (2013.01); *F01N 1/165* (2013.01); *F01N 3/0236* (2013.01); *F01N 13/087* (2013.01); *F01N 2240/36* (2013.01); *F01N 2560/025* (2013.01); *F02D 9/10* (2013.01); *F02D 9/101* (2013.01); *F02D 9/102* (2013.01); *F02D 9/1005* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,372,109 | A * | 12/1994 | Thompson | F02D 9/06 60/324 |
| 6,567,734 | B2 | 5/2003 | Bellinger et al. | |
| 7,121,088 | B2 * | 10/2006 | Lavin | F01N 1/166 60/292 |
| 9,506,426 | B2 | 11/2016 | Remes | |
| 9,695,754 | B2 * | 7/2017 | Cho | F02D 9/06 |
| 9,759,114 | B2 | 9/2017 | Schwartz et al. | |
| 2005/0138923 | A1 * | 6/2005 | Tamura | F02D 9/103 60/324 |

(Continued)

FOREIGN PATENT DOCUMENTS

KR 20200021899 A 3/2020

*Primary Examiner* — Binh Q Tran
(74) *Attorney, Agent, or Firm* — Vincent Mastrogiacomo; Brooks Kushman P.C.

(57) ABSTRACT

An engine exhaust system includes a catalytic converter, an exhaust conduit connected upstream of the catalytic converter, and an oxygen sensor extending into the exhaust conduit at a first axial position of the exhaust conduit. A valve is located within the exhaust conduit at the first axial position. The valve includes a movable throttle plate having a bypass notch formed on a periphery of the plate. The valve has an open position, and a closed position in which the bypass notch is placed adjacent to the oxygen sensor to guide exhaust over the oxygen sensor.

16 Claims, 2 Drawing Sheets

(56) References Cited

U.S. PATENT DOCUMENTS

| | | | | |
|---|---|---|---|---|
| 2007/0214775 | A1* | 9/2007 | I | F01N 13/009 60/299 |
| 2009/0183498 | A1* | 7/2009 | Uchida | F01N 13/009 60/299 |
| 2013/0028818 | A1* | 1/2013 | Eckhoff | B01D 53/9477 422/119 |
| 2015/0267649 | A1* | 9/2015 | Remes | F01N 3/20 60/605.1 |
| 2017/0350335 | A1* | 12/2017 | Muramatsu | F01N 3/24 |
| 2019/0162103 | A1* | 5/2019 | Okamoto | F01N 3/2892 |

* cited by examiner

EXHAUST RESTRICTION DEVICE FOR IMPROVED SENSOR SIGNAL

TECHNICAL FIELD

This disclosure relates to vehicle exhaust systems having a valve associated with an oxygen sensor.

BACKGROUND

Vehicles may include internal-combustion engines such as gasoline or diesel engines. The engine powers one or more wheels of the vehicle via a powertrain. The combustion of fuel within the engine produces waste gases typically referred to as exhaust. An associated exhaust system carries the exhaust from an exhaust manifold to a tailpipe that vents the exhaust to the atmosphere. The exhaust system may include an oxygen sensor that measures the amount of oxygen in the exhaust. The sensor is in communication with a vehicle controller that controls operation of the engine based on reading from the oxygen sensor and other factors.

SUMMARY

According to one embodiment, an engine exhaust system includes a catalytic converter, an exhaust conduit connected upstream of the catalytic converter, and an oxygen sensor extending into the exhaust conduit at a first axial position of the exhaust conduit. A valve is located within the exhaust conduit at the first axial position. The valve includes a movable throttle plate having a bypass notch formed on a periphery of the plate. The valve has an open position, and a closed position in which the bypass notch is placed adjacent to the oxygen sensor to guide exhaust over the oxygen sensor.

According to another embodiment, an engine exhaust system includes an exhaust manifold defining a sensor opening, an oxygen sensor received in the sensor opening, and a valve located within the exhaust manifold at a location corresponding to the sensor opening. The valve including an open position, and a closed position in which an effective cross-sectional area of the exhaust manifold is reduced to concentrate exhaust flow over the oxygen sensor.

According to yet another embodiment, an engine exhaust system includes a catalytic converter, exhaust conduit connected upstream of the catalytic converter and having first and second parallel passages, and an oxygen sensor extending into the first passage. A valve is located within the second passage. The valve includes a closed position in which the exhaust gases are routed through the first passage and an open position in which exhaust gases are routed through both the first and second passages.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
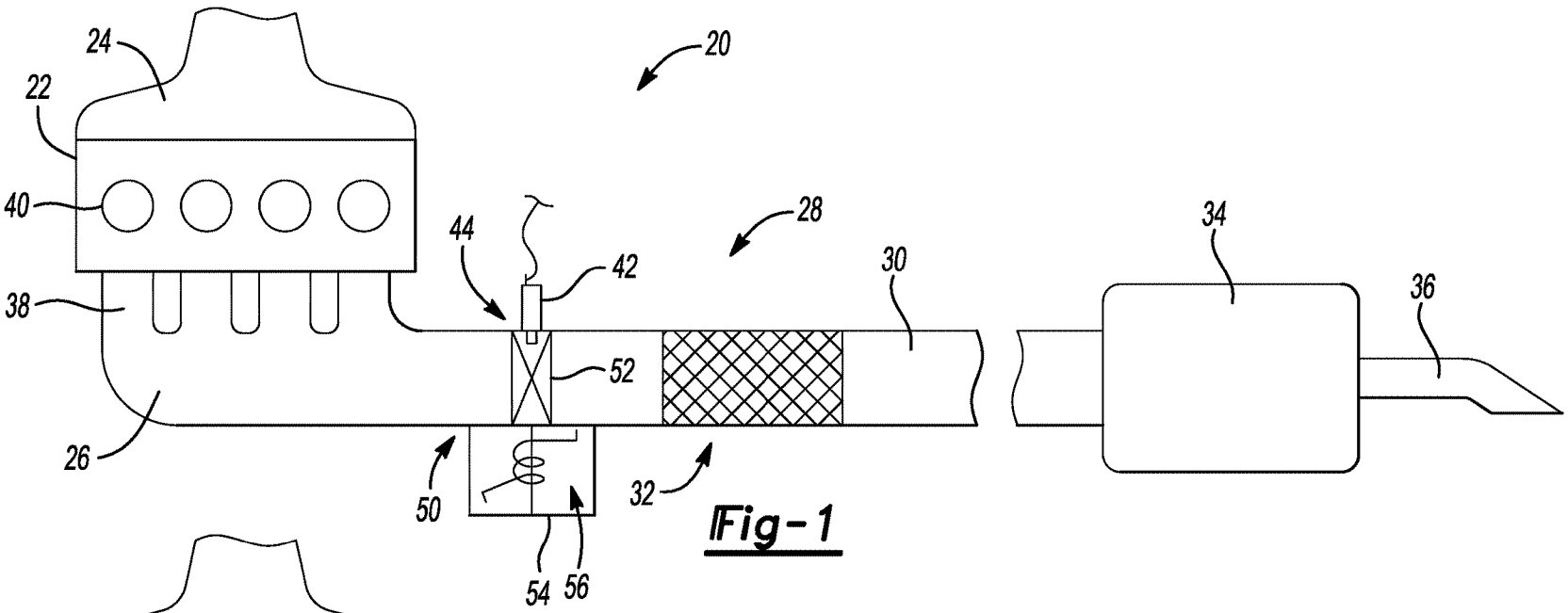
FIG. 1 illustrates a diagrammatical view of an engine system according to one or more embodiments of this disclosure.

Referring to FIG. 1, an engine system 20 includes an engine 22 having an intake manifold 24 and an exhaust manifold 26. The exhaust manifold 26 forms a portion of an exhaust system 28 that routes the exhaust gases produced by the engine 22 to the atmosphere. The exhaust system 28 may include one or more pipes 30, a catalytic converter 32, a muffler 34, and a tailpipe 36. The exhaust carrying components of the exhaust system 28 may be referred to as exhaust conduit. The exhaust manifold 26 may bolt to a block of the engine 22 and includes individual runners 38 associated with each of the cylinders 40. These runners may conjoin within the exhaust manifold 26. The catalytic converter 32 may connect directly to the end of the exhaust manifold 26 to facilitate light-off and reduce emissions or may be connected by an exhaust pipe.

The exhaust system 28 includes one or more oxygen sensors 42 that measure the amount of oxygen in the exhaust. One or more of the oxygen sensors 42 is disposed upstream of the catalytic converter 32 such as in the exhaust manifold 26 or other section of the exhaust conduit, e.g., an exhaust pipe. The exhaust manifold 26 or other exhaust conduit may define a hole 44 that receives a portion of the oxygen sensor 42 therein. For example, the hole 44 may be threaded and receives a threaded portion of the oxygen sensor 42. A tip of the oxygen sensor 42 is disposed within the exhaust conduit to measure the oxygen content of the exhaust.

The sensor 42 is in communication with an engine controller, or the like, that interprets signals from the sensor 42 to determine the amount of oxygen in the exhaust gas. The controller uses this information to control at least the engine. For example, the controller uses the oxygen sensor 42 to determine and, if needed, adjust, the air-fuel ratio of the engine 22. That is, the controller uses the oxygen sensor 42 to detect an air-fuel ratio imbalance. Since the engine 22 includes multiple cylinders, this imbalance may only be occurring in some of the cylinders, and it is useful to know the cylinder-to-cylinder air-fuel ratio imbalance to correct the issue more precisely or notify the driver to service the vehicle if the imbalance is not correctable by the controller e.g., clogged injector.

The controller may determine the air-fuel ratio on a per cylinder basis by coordinating the oxygen sensor readings to engine timing to determine which cylinder the exhaust gas is associated with. In order to do this, fast sampling of the oxygen sensor 42 and a fast transient response is needed. The oxygen-sensor transient response is a function of multiple factors including the exhaust velocity at the sensor. Generally, it is easier to measure or detect an air-fuel ratio imbalance when the exhaust velocity at the sensor 42 is higher as the sensor 42 responds faster to changes in air-fuel ratio from an exhaust pulse from a first cylinder to a following exhaust pulse from a second cylinder. At low engine loads, the exhaust velocity is low resulting in a slow oxygen sensor response. This leads to a low signal-to-noise ratio and makes it more difficult to determine or detect cylinder-to-cylinder air-fuel ratio imbalance.

To solve these and other problems, the exhaust system 28 uses flow control, e.g., a valve, to increase the exhaust velocity at the sensor 42. That is, the exhaust system 28 can control exhaust velocity across the oxygen sensor 42 independent of engine operation to increase exhaust velocity at the sensor 42 as needed. By doing so, the sensor 42 can receive sufficient exhaust gases to monitor cylinder-to-cylinder air-fuel ratio imbalance even at light engine loads.

In one or more embodiments, the exhaust system 28 includes a valve 50 located upstream of the catalytic converter 32. The valve 50 may include a valve body that forms a portion of the exhaust conduit. The valve body may be a separate component that is attached in-line with the other exhaust conduit and defines an interior that houses an actuatable member 52 of the valve 50. The valve 50 can be closed to reduce the effective cross-sectional area of the exhaust conduit at the oxygen sensor 42 and consequently increase the velocity of the exhaust gases. As engine load and/or speed increases, the valve can be opened so that engine performance is unaffected. The valve 50 may be placed on the exhaust conduit at the same axial location as the oxygen sensor 42 so that the reduced effective cross-sectional area produced by closing the valve 50 is located proximate to the oxygen sensor 42.

The actuatable member 52 is disposed within the exhaust conduit, such as the exhaust manifold 26, a body of the valve, or one or more pipes 30 depending upon the placement of the sensor 42. The actuatable member 52 may be a throttle plate, flap, ball, or other object capable of partially blocking the exhaust conduit. An actuation unit 54 of the valve 50 may be disposed outside of the exhaust conduit, such as attached to the outer surface of the valve body, exhaust manifold, or exhaust pipe. The actuatable member 52 is operably coupled to the actuation unit 54 so that the position of the valve 50 can be adjusted between the closed position, the open position, and one or more intermediate positions (optional). (The "closed position" refers to the most closed position and does not require complete closure of the valve. The "open position" refers to the most open position and does not require complete opening of the valve.) The actuation unit 54 may be a passive device or an active device. The passive device may include a resilient member 56 configured to bias the valve 50 to the closed position and configured to gradually open the valve as pressure within the exhaust conduit builds. The resilient member 56 may be a spring, such as the shown clock spring, that acts between the housing of the actuation unit 54 and the actuatable member 52. In embodiments with the active device, the actuation unit 54 may include an electric actuator, such as an electric motor, that rotates or otherwise actuates the actuatable member between the open and closed positions. Here, the controller may actuate the actuatable member based on engine load and/or speed, for example.

Figure 2B:
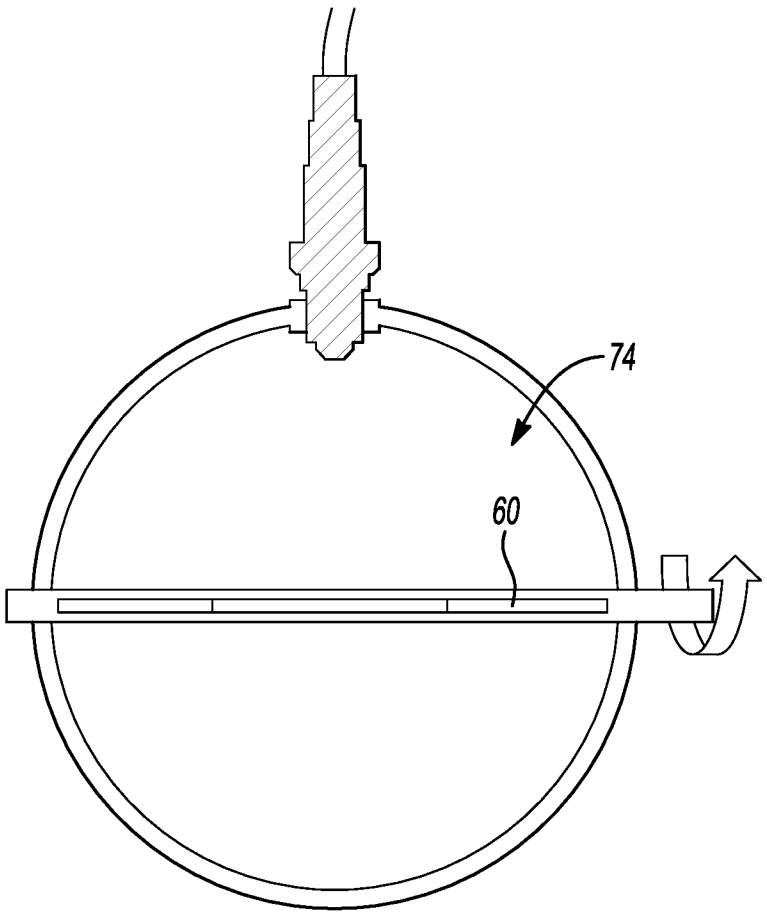
FIG. 2B is a cross-sectional view of the exhaust valve and oxygen sensor assembly with the valve in the open position.
Figure 2A:
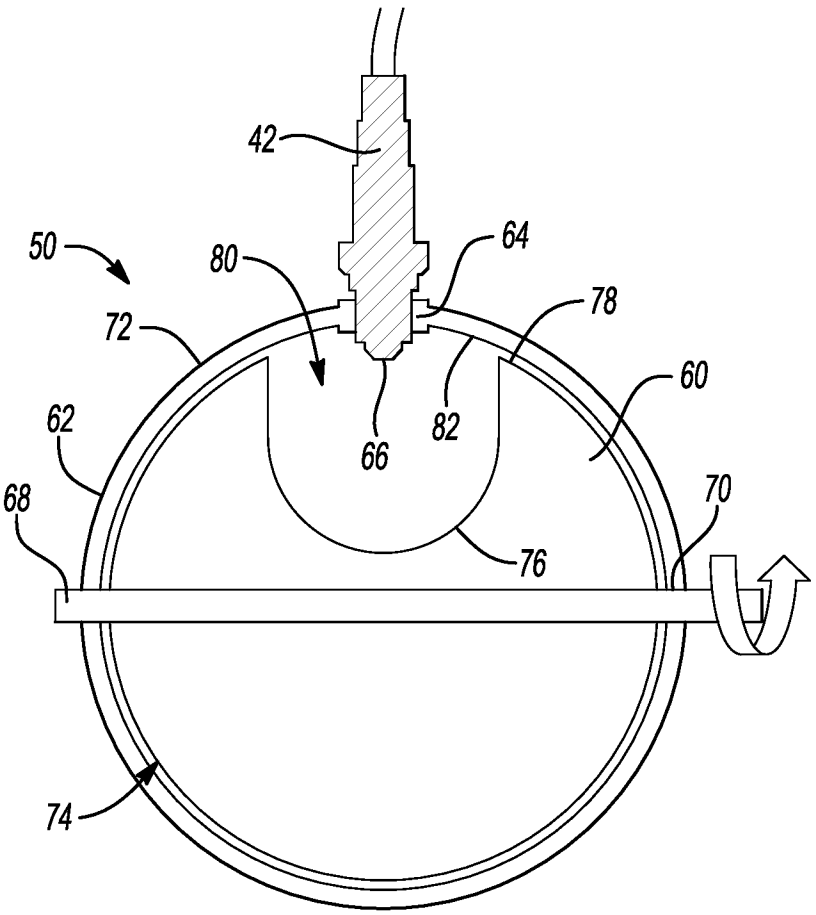
FIG. 2A is a cross-sectional view of an exhaust valve and oxygen sensor assembly with the valve in the closed position.

Referring to FIGS. 2A and 2B, the valve 50 may be a butterfly valve having a throttle plate 60 disposed within an exhaust conduit 62. The exhaust conduit 62 defines a threaded hole 64 that receives a threaded portion of the oxygen sensor 42 such that a tip portion 66 of the sensor is disposed within the interior of the conduit 62. The throttle plate 60 may be a disk having a diameter that substantially matches an inner diameter of the exhaust conduit 62, albeit slightly smaller than the inner diameter of the exhaust conduit 62 so that the disk can freely rotate between the open and closed positions. The disk 60 may be mounted on a shaft 68 that is supported for rotation within the conduit 62. The shaft 68 may be located centrally on the disk 60. The shaft 68 may extend through one or more openings 70 defined in the conduit 62, e.g., a valve body.

In one or more embodiments, the valve 50 may be a separate component that is connected in line with the other exhaust components. Here, the valve 50 includes a valve body 72 that may include a first end attachable to the exhaust manifold 26 and a second end that is attachable to the catalytic converter 32. The body 72 defines a tubular interior 74 configured to carry exhaust therethrough. The body 72 also defines the threaded hole 64 and the oxygen sensor 42. The actuatable member 60 is supported for pivoting within the body 72. For example, the body 72 may define the opening(s) 70 that support the shaft 68. In this embodiment, the actuator 54 may be attached to the exterior surface of the valve body 72.

The throttle plate 60 is located at a same axial position along a centerline of the exhaust system as the oxygen sensor 42. The throttle plate 60 has a bypass notch 76 formed on, and extending inwardly from, a periphery 78 of the plate 60. The notch 76 provides clearance for the tip 66 of the oxygen sensor 42 and defines a small fluid passage 80 having a reduced effective cross-sectional area relative to the inner diameter 82 of the exhaust conduit. The fluid passage 80 is adjacent to the oxygen sensor 42 to force the exhaust gases across the tip 66. When in the closed position, the throttle plate 60 reduces the area of the flow path by forcing the exhaust through the small notch 76. This increases the velocity of the exhaust gases, which aids the sensor 42 in determining or detecting cylinder-to-cylinder air-fuel ratio imbalance.

In FIG. 2B, the actuatable member 60 is in the open position, which provides a much larger effective cross-sectional area than the closed position. The actuatable member 60 may be placed in the open position during heavy engine loads to reduce back pressure and provide optimum engine performance. During heavy engine loads, the flow rate of the exhaust through the exhaust conduit is high and the velocity, even with the actuatable member in the open position, is sufficient to allow the oxygen sensor 42 to measure cylinder-to-cylinder air-fuel ratio imbalance. The actuatable member may be placed in one or more intermediate positions based on the flow rate of the exhaust, which correlates to the engine load and/or speed. The intermediate positions may balance exhaust velocity across the sensor tip 66 with the back pressure to provide the desired engine performance.

As explained above, the actuatable member may be passively operated based on the pressure of the exhaust or may be actively controlled by an electric actuator. In the passive embodiment, the actuatable member 60 is biased to the closed position and slowly opens as exhaust pressure builds against the actuatable member 60. For example, the actuatable member 60 begins to rotate responsive to the exhaust pressure exceeding the spring force that biases the actuatable member 60. The actuatable member 60 then opens more and more as the exhaust flow increases until the open position is reached. The actuatable member 60 will again rotate towards the closed position if the driver reduces the engine load.

Figure 3:
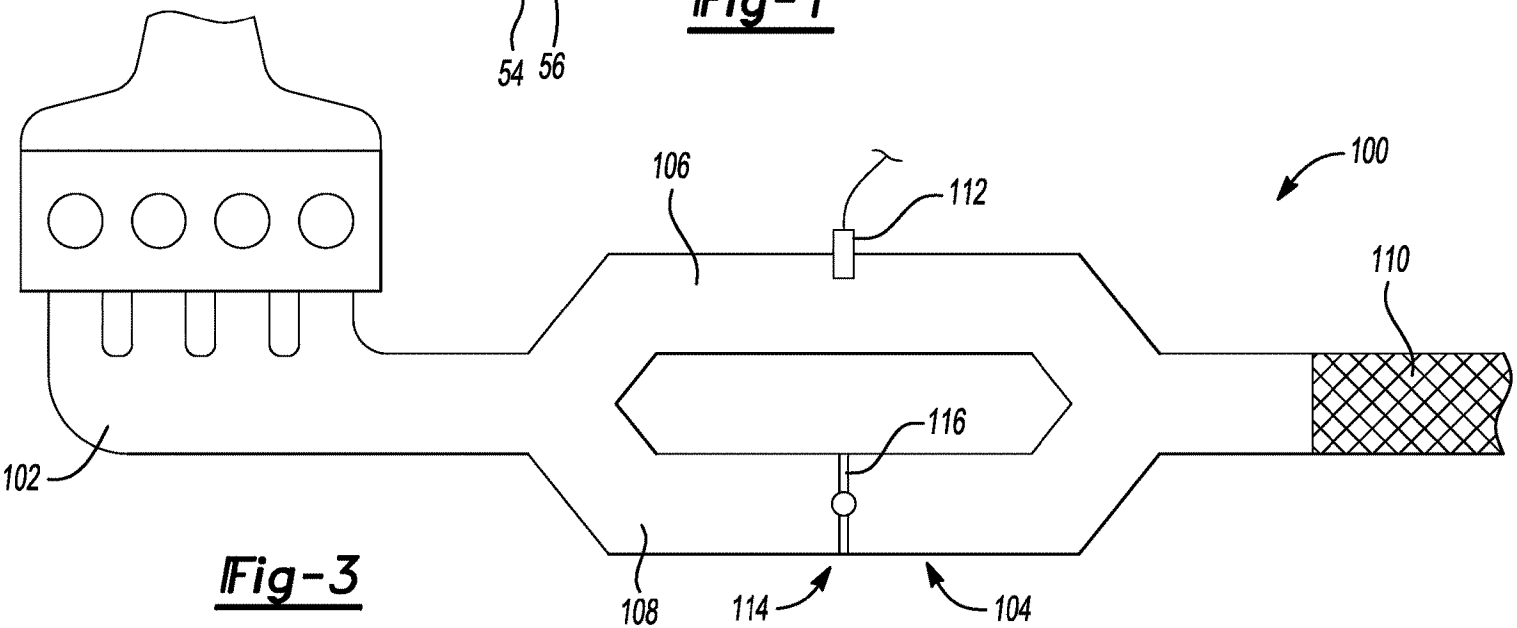
FIG. 3 illustrates a diagrammatical view of an engine system according to one ore more alternative embodiments of this disclosure.

FIG. 3 illustrates an alternative embodiment of an exhaust system 100. The exhaust system 100 includes an exhaust manifold 102, a pipe branch section 104 having first and second parallel passages or branches 106, 108, and a catalytic converter 110. The first passage 106 supports the oxygen sensor 112 and the second passage 108 includes a valve 114. The valve may be similar to the above-described valve 50 except it does not include a notch and is designed to block the second passage 108 when in the closed position. For example, the valve 114 may be a butterfly valve having a throttle plate 116 that is supported for rotation within the passage 108. The valve 114 may be biased to the closed position as discussed above. When the valve 114 is in the closed position, the exhaust gases are routed mostly through the first passage 106 and across the oxygen sensor 112. Since the closed valve reduces the effective cross-sectional area of the branch section 104, the exhaust velocity across the oxygen sensor 112 is increased. The valve 114 is rotatable to the open position based on the engine load and speed as described above. When the valve is in the open position, the exhaust gases pass through the first and second branches 106, 108 thus increasing the effective cross-sectional area of the exhaust conduit to mitigate back pressure during higher engine loads and speed. The valve 114 may also be actively controlled as discussed above.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An engine exhaust system comprising:

a catalytic converter;

an exhaust conduit connected upstream of the catalytic converter;

an oxygen sensor extending into the exhaust conduit at a first axial position of the exhaust conduit; and a valve located within the exhaust conduit at the first axial position, the valve including a movable throttle plate having a bypass notch formed on a periphery of the plate, wherein the valve includes an open position and a closed position in which the bypass notch is placed adjacent to the oxygen sensor to guide exhaust over the oxygen sensor.

2. The engine exhaust system of claim 1, wherein the valve is a butterfly valve.

3. The engine exhaust system of claim 1, wherein the throttle plate is biased to the closed position and is configured to move towards the open position based on exhaust pressure within the exhaust conduit.

4. The engine exhaust system of claim 1, wherein the valve further includes a resilient member configured to bias the throttle plate to the closed position.

5. The engine exhaust system of claim 4, wherein the resilient member is a spring.

6. The engine exhaust system of claim 1, wherein the valve further includes a shaft, at the first axial position, that is pivotally attached to the exhaust conduit and that supports the throttle plate.

7. The engine exhaust system of claim 6 further comprising an actuation unit attached to an outer surface of the exhaust conduit and operably coupled to the shaft.

8. The engine exhaust system of claim 7, wherein the actuation unit includes a resilient member configured to rotate the shaft towards the closed position.

9. The engine exhaust system of claim 7, wherein the actuation unit includes an electric actuator configured to rotate the shaft to move the throttle plate between the open and closed positions.

10. The engine exhaust system of claim 1, wherein the throttle plate is a disk having a diameter that substantially matches an inner diameter of the exhaust conduit at the first axial position.

11. The engine exhaust system of claim 9, wherein a depth of the notch is less than a radius of the disk.

12. An engine exhaust system comprising:

an exhaust manifold defining a sensor opening;

an oxygen sensor received in the sensor opening; and a valve located within the exhaust manifold at a location corresponding to the sensor opening, the valve including a plate which pivots between an open position and a closed position in which an effective cross-sectional area of the exhaust manifold is reduced to concentrate exhaust flow over the oxygen sensor, the plate defining a notch that cooperates with the exhaust manifold to define the effective cross-sectional area.

13. The engine exhaust system of claim 12, wherein the effective cross-sectional area is defined at least partially by an opening in the valve.

14. The engine exhaust system of claim 12, wherein the valve is biased to the closed position and is configured to move towards the open position based on exhaust pressure within the exhaust manifold.

15. The engine exhaust system of claim 14, wherein the valve further includes a resilient member that biases the valve to the closed position.

16. The engine exhaust system of claim 12, wherein the valve is a butterfly valve.

* * * * *